United States Patent [19]

De Baker et al.

[11] 4,099,679

[45] Jul. 11, 1978

[54] DUAL YARN TIE-UP AND TRANSFER TAIL APPARATUS

[75] Inventors: Joseph R. De Baker, Kingsport; Albert E. Spaller, Jr., Johnson City, both of Tenn.

[73] Assignee: Eastman Kodak Company, Rochester, N.Y.

[21] Appl. No.: 817,274

[22] Filed: Jul. 20, 1977

[51] Int. Cl.[2] ..... B65H 54/02; B65H 54/34

[52] U.S. Cl. ..... 242/18 PW; 242/125.1

[58] Field of Search ..... 242/18 PW, 18 A, 125, 242/125.1; 57/34 TT

[56] References Cited

U.S. PATENT DOCUMENTS

| | | | |
|---|---|---|---|
| 3,097,804 | 7/1963 | Jackson | 242/18 PW |
| 3,149,795 | 9/1964 | Rhein, Jr. | 242/18 A |
| 3,276,704 | 10/1966 | Pabis | 242/18 PW |
| 3,284,023 | 11/1966 | Sowell | 242/125.1 |
| 3,326,494 | 6/1967 | Hartley, Jr. | 242/125.1 |
| 3,385,532 | 5/1968 | Sparling | 242/18 PW |
| 3,625,451 | 12/1971 | Anderson | 242/125.1 |
| 3,717,291 | 2/1973 | Adams et al. | 242/125.1 |
| 3,964,721 | 6/1976 | Owens et al. | 242/18 PW |
| 3,971,518 | 7/1976 | Newman et al. | 242/18 PW |
| 4,046,329 | 9/1977 | Eisenberg et al. | 242/18 PW |

FOREIGN PATENT DOCUMENTS

| | | | |
|---|---|---|---|
| 2,547,401 | 5/1976 | Fed. Rep. of Germany | 242/18 PW |
| 2,534,699 | 2/1977 | Fed. Rep. of Germany | 242/18 PW |

*Primary Examiner*—Stanley N. Gilreath

*Attorney, Agent, or Firm*—Malcolm G. Dunn; Daiel B. Reece, III

[57] ABSTRACT

An improved apparatus for tying-up yarn to and for forming a transfer tail on one or more textile yarn package tubes mounted on the same yarn winder mandrel, each yarn package tube having a groove and a corner, which is formed in one of the side walls of the groove, with which the apparatus cooperates to make the tie-up and to form the transfer tail.

16 Claims, 7 Drawing Figures

DUAL YARN TIE-UP AND TRANSFER TAIL APPARATUS

BACKGROUND

This invention is directed to an apparatus for tying-up yarn to a yarn package tube and for forming a transfer tail thereon, and particularly to an improved apparatus for tying-up yarn to and for forming a transfer tail on one or more textile or industrial yarn package tubes mounted on the same yarn winder mandrel with each yarn package tube having a groove and cross-cut notch with which the apparatus cooperates to make the tie-up and to form the transfer tail, the yarn package tube, method and an apparatus for practicing the method disclosed in copending U.S. Patent Application Ser. No. 817,276, filed July 20, 1977, the same date as the instant application, in the name of William A. Thomas, Jr.

Other devices and apparatus for forming transfer tails on yarn package supports, particularly on yarn package supports that are rotating at the desired yarn package winding speeds, are well known in the art. Some of these prior art devices or apparatus are represented in the Newman et al patent, U.S. Pat. Nos. 3,971,518; the Spaller patent, 3,999,716; the Pabis patent, 3,276,704; the Rhein, Jr. patent 3,149,795; the Nugent patent, 3,224,692; the Ratti patent, 3,575,355, the Emery patent, 3,428,266; the Porter patent, 3,282,516; and the Bolger patent, 3,275,252.

Other types of yarn package tubes on which transfer tails and yarn packages are wound are also well-known in the art. Some representative patents disclosing such yarn package tubes are Adams et al, U.S. Pat. No. 3,717,291; Sowell, U.S. Pat. No. 3,284,023; Heatherly, 3,103,305; and Pabis 3,276,704. The latter patent, Pabis, also discloses that it is well-known to tie-up yarn at the same time and form transfer tails thereon to two yarn rubes mounted on the same yarn winder mandrel.

The textile winders concerned with this invention usually involve a yarn package support, which may be surface-driven, and where the traversing action for even distribution of the yarn on the yarn package support may be obtained by use of a drive roll having a spiral groove in its surface to traverse the yarn as it is wound on the package, as in the case of the above-mentioned Nugent patent, U.S. Patent No. 3,224,692. The traversing action may also be accomplished by the reciprocating motion of a yarn traverse guide through which the yarn advances to the yarn package support or tube, as in the case of the above-mentioned Newman et al patent, U.S. Pat. No. 3,971,518; Spaller patent 3,999,716; and the Pabis patent, 3,276,704.

The "transfer tail" is an initial wrap or turn or series of wraps or turns in the form of a single layer of a short length of helices at one end of the yarn package support or tube just outside the package portion of the tube. The purpose of the transfer tail is to facilitate the tying of the outer end of yarn from another yarn package to the transfer tail of the yarn package being processed or used in a textile mill so as to preserve the continuity of the operating process without the necessity of shutting equipment down when a yarn package becomes depleted. Hence, the transfer tail yarn quality must be comparable to the rest of the yarn in the package.

The winder for which this invention, the transfer tail apparatus, is particularly adapted is the BARMAG SW4S series Winder, Barmer Machinefabrik A.G., which winds yarn onto packages at speeds in excess of 3000 meters per minute. In making transfer tails on yarn packages at these speeds any excessive slack in the winding system generated following the tie-up or connection of the yarn to the yarn package support or tube can cause a number of problems. "Tie-up", for purposes of this description, means connection of the yarn to the yarn package tube.

Initially, before tie-up of the yarn to the yarn package tube, the yarn is traveling toward the winder at speeds in excess of 3000 meters per minute. The yarn is being taken up by a waste aspirator or air doffer, which also serves to maintain the desired tension on the yarn. Any momentary excessive slack in tension following the moment of tie-up to the yarn package tube can cause a roll wrap around the godet roll that precedes the winder. The roll wrap would thus cause a breakdown of the system. If, for whatever reason, a roll wrap should fortuitously be avoided, despite the presence of undesirable slack, and a successful tie-up should be made to the yarn package tube, slack yarn will be present during winding the first few layers of yarn on the yarn package tube. This can cause separated or spread filaments next to the surface of the tube, and thus cause damage filaments.

Another problem resulting from undesirable slack is that the yarn is not pulled sufficiently tight on the traverse guide, and thus on the pick-up of the yarn by the traverse guide the latter does not pick up all of the filaments at the same time, but instead picks up the remainder on the next reciprocation. This results in the filaments becoming undesirably separated, and can cause a breakdown of the yarn end during subsequent processing.

Still another problem resulting from excessive slack: Since the yarn layers next to the tube surface are not tensioned the same as the outer yarn layers, a potential dye take-up difference problem is created.

The separated filament problem also extends to the transfer tail when the yarn is either of low twist or is a non-TF (non-entangled filament) yarn. The filaments become separated in the transfer tail, with the possibility that the entire strand of yarn may not be tied-up to the next successive package during yarn processing. If the filaments are picked up out of phase, some of the yarn strands will be drawn more than other strands when the yarn being wound is only partially oriented. When the yarn is later processed, such as by undergoing a draw texturing operation, the subsequent resulting different dye take-up in a dyeing process may cause flashes in fabric made from such yarn.

An object of the present invention is to reduce slack in the yarn to a minimum at the time following tie-up or connection of the yarn to the yarn package support or tube.

Some of the transfer tail apparatus and devices in the prior art depend upon yarn tension for causing movement of the transfer tail device. Since yarn tension can vary, this will result in different movement or rotational rates in the transfer tail device which may thus cause the helices to be too closely spaced so as to make it difficult for the operator to find a yarn end and tie-up to the next yarn package. If the transfer tail is too widely spaced, the length of the tail may be too short to enable tie-up to the next yarn package.

For instance, the transfer tail device provided by Barmer Machinenfabrik A.G. on the BARMAG SW4S Winder comprises a light-weight arm that rotates as a result of the yarn releasing a latch and exerting a force on the arm by the tension of the yarn. The spacing between helices or turns in the transfer tail on the yarn package tube depends upon the rate of rotation of the arm which in turn depends upon the tension of the yarn, bearing friction, and inertia of the arm. The latch is connected to the arm, and adjustments made to account for changes in the path of the yarn in order to insure proper release of the latch alter the inertia of the arm. Small changes in the inertia and friction will occur and affect the rotation of the arm since the low yarn tension forces are the only forces for causing rotation of the light-weight arm.

An object of the invention, therefore, is to provide an apparatus which will enable winding of transfer tails on yarn package tubes in a controlled, repeatable manner independent of variations in yarn tension, path of the yarn, and friction changes.

Another object of the present invention is to provide a transfer tail apparatus in which yarn tension has little effect in the operation of the transfer tail apparatus. Yarn tension is relied on only to hold the yarn in its proper place in the transfer tail apparatus as the yarn approaches the winder. Thus, since the transfer tail apparatus is not dependent upon yarn tension for its operation, such yarn tension otherwise tending to be variable, repeatability of the desired transfer tail is made more certain.

In the method and apparatus for practicing the method that are disclosed in the above-mentioned copending William A. Thomas, Jr., patent application, when the yarn is tied-up to the yarn package tube, the waste bunch is disclosed as being wound in and on top of the groove that is formed in the yarn package tube. In one of the disclosed apparatus embodiments, for instance, the one yarn guide illustrated is positioned along one side of the tube (front side as viewed in the drawing) in alignment with the groove. Then when, by means of an air doffer, the yarn tie-up is made to the tube, the yarn running through the yarn guide to the tube is guided thereby to wrap in and on top of the groove in the tube as the tube rotates. In another of the disclosed embodiments, a yarn guide is positioned along the lengths of both the front and back sides (as illustrated) of the tube. The front yarn guide is initially moved to be in alignment with the groove in the tube while at the same time the back yarn guide moves with the front yarn guide to provide the yarn sideways along the tube length toward the groove. After the tie-up, the yarn is guided by the front yarn guide to form a waste bunch in and on top of the groove.

It has since been discovered, however, that the waste bunch that was wound in and on top of the groove would at times be found to be too loosely wound. When this condition occurred, it would occasionally result in damaged yarn in both the waste bunch and the transfer tail. It was thus subsequently discovered in the practice of the invention disclosed in the Thomas, Jr. patent application, that if the waste bunch were wound on the surface of the tube instead of in and on top of the groove, the occasional loose waste bunch was eliminated and the appearance of the transfer tail was greatly improved. Further work established that the yarn guide in front of the tube could remain in a stationary position to one side of the groove during tie-up and the winding of the waste bunch. This greatly simplified the mechanism required for controlling the front yarn guide.

Another problem noticed in the practice of the invention disclosed in the Thomas, Jr. patent application, which turned out to be a potential source of wound-in waste on many of the tubes having yarn wound thereon, was the presence of a long strand of yarn extending from the point of tie-up on the yarn package tube. It was found that the yarn strand was caused by the yarn breaking near the air doffer rather than at the groove in the tube. Further work on this problem showed that if the back or rear guide, as illustrated in the Thomas, Jr. patent application, was modified to move in a nearly horizontal plane at a distance of about one-half inch from the tube and on an approximate level with the axis of the tube, such as the horizontal axis illustrated, the yarn would break between the groove and rear yarn guide or at the rear yarn guide. The length of the yarn strand was thus considerably reduced, and the problems formerly associated with the longer length seem to have been minimized.

Still another object of the invention, therefore, is to provide an apparatus that will result in the winding of tight waste bunches and hence improve the appearance of the subsequently wound transfer tail, and without the problem of unwanted wound-in waste.

The winding of two yarn packages at the same time, when mounted in end-to-end relation on the same mandrel, i.e., a dual winding process, is well-known in the art. The winding is usually carried out in the same direction, as viewed from the end on which winding is initiated in order that unwinding from several packages grouped together will all be in the same direction. Also, in such dual winding processes, it is well-known that the transfer tails for both yarns should be effected substantially simultaneously so as to avoid any possibility of variability in the properties of the yarn in each package. The Parry U.S. Pat. No. 3,488,010 discloses such a dual winding process.

A further object of the present invention is to provide a transfer tail apparatus that may form at the same time a transfer tail on each yarn package tube that may be mounted on the same mandrel of the yarn winder, each yarn package tube being mounted end-to-end on the same winder mandrel.

SUMMARY OF THE INVENTION

The invention thus concerns an improved apparatus over the apparatus disclosed in the copending Thomas, Jr. patent application and by which and in cooperation with the yarn package tube disclosed in the Thomas, Jr. patent application yarn is tied-up and a transfer tail is formed on the outer end of one or more rotating yarn package tubes mounted on the same winder mandrel when the yarn for each package tube is traveling at speeds in excess of 3000 meters per minute. The apparatus is, of course, also capable of being used with winders operating at slower speeds. The yarn winder may have a self-threading yarn traverse guide, which is driven in reciprocation along a path that is parallelly spaced from the package portion of the yarn package tube and which guides the yarn onto the package portion of the tube.

(a) The Thomas, Jr. Yarn Package Tube

The textile yarn package tube, as disclosed by the aforementioned Thomas, Jr., is preferably made of multi-ply paper, although it may also be made from other suitable materials. The tube has a substantially cylindrical body, which has formed in its external surface adjacent one end thereof a groove defined by a pair of side walls extending into the surface of the cylindrical body and extending at least partly around the body in a plane substantially perpendicular to the rotation axis of the tube. Grooves per se, as previously stated, are well-known in the art.

What appears to be new as the yarn package tube, however, and as disclosed by Thomas, Jr., is the provision of a structure located on the yarn package tube adjacent the groove for cooperation therewith and by which in rotary winding operations, as a yarn enters the groove in one direction of movement, a portion of the yarn exiting from the groove is snagged and deflected around the cooperating adjacent structure for changing the direction of movement of the exiting yarn portion as the adjacent structure is rotated with the yarn package tube.

The structure on the yarn package tube is preferably located between the groove and the above-mentioned one end of the cylindrical body to which the groove is adjacent.

The "adjacent cooperating structure" could be a pin, which could extend from the surface of the yarn package tube adjacent the groove. The portion of yarn exiting from the groove could be deflected partly around the pin for movement momentarily in a different direction as the pin rotates with the tube away from where the yarn first enters the groove. A pin may not be commercially practical, however, because it might interfere with the step on a stepped drive roll. Also, there would be the additional expense involved in making and securing the pin in the yarn package tube.

The "adjacent" structure that cooperates with the groove is, therefore, more preferably defined by a corner, which is formed in the surface of the tube in one of the side walls of the groove. The corner points in the direction of intended rotation of the tube when the tube is supported for such rotation upon a winder mandrel and includes a side wall intersecting one side wall of the groove in an angle, preferably an acute angle. The acute angle may be within the range of about 25° to about 60°, and is preferably about 30° to about 45°, and is still more preferred to be about 35° . One of the limiting factors for the low end of the maximum range of angles appears to be dependent upon the nature of the material from which yarn package is made. If the tube is made from multi-ply paper, the acute-angled corner may become too thin and thus become torn out during the tie-up operation. A limiting factor for the high end of the maximum range of angles appears to be dependent upon how well the yarn is retained and deflected by the acute-angled corner. Thus, the maximum range of angles that may be used is only approximate, with the preferred angles and still more preferred angle giving more assurance of carrying out their intended purpose.

In forming the corner, the acute-angled corner may be displaced from the groove wall, with which one of the corner side walls intersects, in a direction toward the opposite side wall of the groove, with the acute-angled corner extending in part over the groove.

Also, in forming the corner, the corner may be raised slightly above the surface of the cylindrical body of the yarn package tube.

Further, in forming the corner, the acute-angled corner may be both displaced in part over the groove and raised slightly above the surface of the cylindrical body of the yarn package tube.

In either situation of displacement of the acute-angled corner or slightly raising the acute-angled corner, or using a combination of both situations, more assurance is provided that the yarn exiting from the groove will be picked-up or snagged and deflected by the acute-angled corner in the manner described.

The side walls of the groove in the yarn package tube define, respectively, an outboard wall adjacent the one end of the tube cylindrical body, and an inboard wall that is spaced axially inwardly along the tube cylindrical body from the inboard wall. The one side wall of the corner preferably intersects the outboard wall of the groove, thus the corner is on the side of the groove axially outwardly along the tube cylindrical body from the groove.

The pair of side walls of the groove in the tube cylindrical body may preferably meet in an acute angle at the bottom of the groove so as to pinch the yarn to trap or to restrict yarn movement relative to the tube once the yarn has been tied-up to the tube and snapped and severed from the yarn moving away from the tube, as into a yarn or waste air doffer.

The corner is bounded on one side by a cross-cut notch that is defined by a pair of side walls that converge to an acute angle away from the groove side wall with which the side walls of the cross-cut notch intersect. The converging side walls of the cross-cut notch may pinch the yarn to trap or restrict yarn movement relative to the tube to assist in snagging, snapping and severing of the yarn. For this reason also, it may be preferable to make the yarn package tube from multiply paper so, in addition to the yarn being deflected around the acute-angled corner, the yarn will also become pinched between the plies of the paper tube within the acute-angled corner.

(b) The Thomas, Jr. Method

In the method of the Thomas, Jr. invention, as particularly practiced with the yarn package tube described above, and as being supported on a rotating yarn winder mandrel, the yarn is moving from a source of supply (not shown) to the yarn package tube for engagement with a portion of the surface thereof and for subsequent movement away from the tube, as into an air doffer. It should be especially noted that the portion of the tube surface with which the yarn engages is rotating in the same direction as the direction of yarn movement.

In the prior art, the yarn usually moves in a direction that is the reverse of tube rotation, such as occurs, for instance, in the above-mentioned Pabis patent, U.S. Pat. No. 3,276,704. Then, when the yarn is snagged by the groove in Pabis, slack will occur in the yarn until the tube has rotated about 180° and thus thereafter takes up the tension on the yarn. In the Thomas, Jr. invention, since the yarn and the surface portion of the tube contacted by the yarn are moving in the same direction, any possible slack at the movement of deflection and snagging is either eliminated or is significantly minimized to such extent that no roll wrap will occur on any preceding godet roll (not shown) that may exist along the yarn path prior to reaching the yarn winder.

In the method of the Thomas, Jr. invention, therefore, the yarn is first positioned for engagement with the surface portion of the rotating supported yarn package tube in a partial arch at the initial location along the tube length that is away from and out of contact with the groove and the adjacent structure or adjacent corner. The "partial arch" is in part a consequence of the yarn bearing in engagement against an arcuate surface portion of the cylindrical tube. The "partial arch" also insures that the yarn will be sufficiently urged toward the surface of the tube so that the yarn will drop readily into the groove when the yarn is moved sideways to the groove. The positioning of the yarn at an "initial location" along the tube length must be such that the yarn does not come into contact with the groove or drop into the groove before the operator is ready to make the tie-up of the yarn to the yarn package tube.

The yarn is then guided sideways along the surface of the rotating yarn package tube toward the groove and adjacent cooperating structure or cooperating corner until the yarn drops into the groove and the exiting portion of the yarn engages the adjacent structure or acute-angled corner and becomes snagged and deflected therearound with its direction of movement being changed as the adjacent structure or acute-angled corner rotates with the tube away from where the yarn approaches the referred-to surface portion of the tube. The yarn, as a consequence of such snagging and deflection, thus becomes tied-up to the tube, and subsequently is snapped and severed from the yarn going away from the tube.

When the exiting yarn portion is "deflected", the consequent change of its direction of movement is only momentary. As the deflecting structure, such as a pin or the more preferred acute-angled corner, rotates with the tube, carrying with it a portion of the yarn, the tension suddenly exerted on the yarn between the deflecting structure and where the yarn is going into the air doffer increases to the extent that the yarn snaps and breaks or becomes severed.

After the tie-up of the yarn to the yarn package tube, the yarn is wound into a predetermined number of wraps on the tube, as the tube continues to rotate, to form a waste bunch; next, the yarn is wound into a predetermined number of spaced apart helical wraps to form a transfer tail adjacent the waste bunch; and finally, the yarn is wound into a yarn package adjacent the transfer tail. The wrapping of waste bunches and transfer tails is well-known in the art. There are many different ways to accomplish this. Some of the same problems, however, have always been presented: How to reproduce good transfer tails on each and every yarn package. How to assure that all of the filaments for a yarn end are in the transfer tail so that when a yarn processing operator pulls out a yarn end from the transfer tail, some of the filaments are not trapped in the yarn package or otherwise separated from the bundle that is supposed to comprise the yarn end.

(c) Improved Apparatus of the Instant Invention

The improved apparatus of this invention, and as mounted on a yarn winder in cooperation therewith, cooperates also with the above-described yarn package tube to tie-up yarn to the yarn package tube and then form a transfer tail thereon prior to the winding of the yarn on the tube to form the yarn package portion. The yarn is moving from a source of supply (not shown) to the apparatus, as in the manner disclosed in the above-described method, and then away from the apparatus as to an air doffer, for instance.

The apparatus has an arrangement for positioning the yarn in a partial arch at an initial location along the tube length that is away from and out of contact with the groove and corner that is formed in one of the side walls of the groove. The arrangement includes for each yarn package tube mounted on the same winder mandrel a yarn laying guide and a pigtail yarn guide. The yarn laying guide is mounted at one position along the length of one side of the tube. The mounted position of the yarn laying guide, unlike that disclosed in the Thomas, Jr. invention is located slightly axially inwardly of alignment with the groove on the yarn package tube. The pigtail yarn guide is mounted at a position along the length of the other side of the yarn package tube axially inwardly of alignment with the groove. The operator, by means of an air doffer in preparation for tie-up of the yarn to the yarn package tube, threads-up each set of yarn guides. Each yarn laying guide and each pigtail yarn guide are each adapted to be moved by the operator in a predetermined path, from a first position to a latched position, threaded-up by the operator, and upon release by the operator from the latched position, to be moved in return along the path to the first position. The return movement of each of the guides may be powered and controlled by a spring arrangement, which is adjustable and sufficiently large and steady as compared to the tension on the yarn and to any frictional change in the system.

When the yarn laying guide and pigtail yarn guide has been moved to their latched positions and threaded-up, the winder head is lowered into surface driving engagement with the yarn package tube. The yarn is now moving continuously from a source of supply to the yarn laying guide; from the yarn laying guide around the grooved yarn traversing roll and then in a partial arch in engagement with a surface portion of the yarn package tube at a location along the yarn tube surface axially inwardly of the groove and to and through the pigtail guide; and from the pigtail guide to and into the air doffer. The yarn is moving in the same direction as the surface portion engaged by the yarn is rotating.

The yarn laying guide, when in the latched position, is in alignment slightly axially inwardly along the length of the tube or inboard of the groove but outside of alignment with the area that is to be the yarn package portion.

The yarn laying guide remains stationary, while the pigtail yarn guide, which is positioned on the opposite side of the yarn package tube from the yarn laying guide, upon being released for movement in return to its first position, guides the yarn sideways along the surface of the rotating yarn package tube until the moving yarn drops into the groove and the portion of the yarn exiting from the groove engages the acute-angled corner and becomes snagged and deflected therearound with its direction of movement being changed as the acute-angled corner rotates away from where the yarn approaches the referred-to surface portion of the tube. The yarn, as a consequence of such snagging and deflection, thus becomes tied-up to the tube, and subsequently is snapped and severed from the yarn going away from the tube and through the pigtail yarn guide.

When the exiting yarn portion is "deflected", the consequent change of its direction of movement is only momentary. As the deflecting structure, such as a pin or the more preferred acute-angled corner, rotates with the tube, carrying with it a portion of the yarn, the tension suddenly exerted on the yarn between the deflecting structure and where the yarn is going into the air doffer increases to the extent that the yarn snaps and breaks or becomes severed. In the use of a multi-ply yarn package tube, the yarn slips not only around the corner but also becomes pinched between the paper plies.

The yarn, as snagged and deflected by the corner and severed from the yarn going through the pigtail yarn guide and into the air doffer, is now being guided only by the yarn laying guide, and as the tube continues to rotate a waste bunch of yarn is formed on the tube inboard of the groove. The pigtail yarn guide in the meantime is continuing its return movement and when it reaches a predetermined position during such return movement, it triggers the release of the yarn laying guide for its movement in return to its first position. As the yarn laying guide moves toward its first position it guides the yarn laterally from the waste bunch toward the package portion moving at a rate of speed correlated with the rotation of the yarn package tube to form a yarn transfer tail of spaced spiral wraps. When the yarn laying guide reaches a predetermined point along its path of movement, the yarn slips free from the yarn laying guide and is picked up by the winder yarn traverse guide and the grooved portion of the grooved yarn traversing roll for winding of the yarn on the package portion of the tube.

Figure 5A:
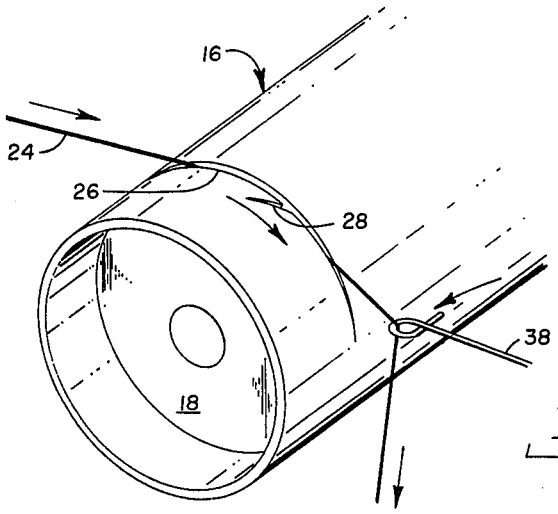
Figure 5B:
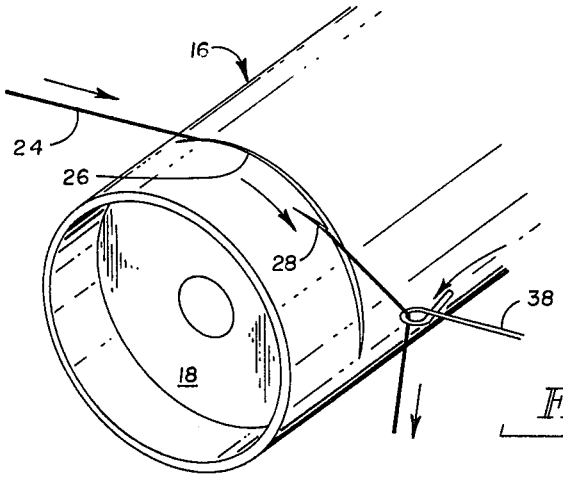
Figure 5C:
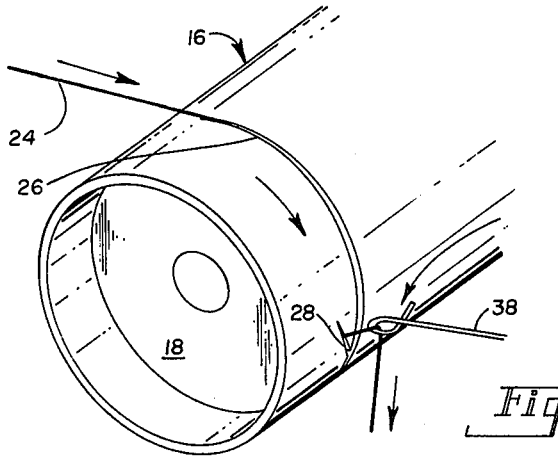

FIG. **5*a*** is an isometric view of a portion of the yarn package tube and of the pigtail guide portion to illustrate the path of the yarn after it has dropped into the groove;

FIG. **5*b* is a view similar to FIG. 5*a* but illustrating how the yarn is about to be picked-up from the groove by the acute-angled corner as the pigtail portion continues its swinging movement; and FIG. 5*c* is a view similar to FIGS. 5*a* and 5*b*** but illustrating the yarn being deflected by the acute-angled corner.

DESCRIPTION OF THE PREFERRED EMBODIMENT

In reference to the drawings, the yarn winder is shown generally and in part at 10, and for the part shown may comprise the housing 12; the drive roll 14 for surface drive engagement with the yarn package tube 16, which is mounted on the winder mandrel 18; and a grooved yarn traverse roll 20 and a cam-driven yarn traverse guide 22, which guide the yarn 24 onto the yarn package tube to form a yarn package. The drive roll for the BARMAG winder is a stepped drive roll, the stepped portion is not illustrated. The cam for driving the yarn traverse guide along its reciprocating path is now shown.

The transfer tail apparatus may be operatively connected to the housing 12 of the yarn winder 10, and is designed to cooperate with a unique yarn tie-up arrangement on the yarn package tube 16. As heretofore mentioned, the yarn winder may be adapted to wind more than one yarn package tube mounted in end-to-end relationship on the same winder mandrel 18, thus the yarn winder may have an individual transfer tail apparatus for each yarn package tube that the yarn winder is capable of handling. A description of a single yarn package tube and its related transfer tail apparatus will thus be applicable to each of any number of such tubes and their respective related transfer tail apparatus.

Yarn Package Tube

The yarn package tube 16 is mounted on the winder mandrel 18 so that the tube end having the above-mentioned groove and deflecting structure is positioned outermost or axially outwardly from the winder. An additional tube or tubes will be mounted in abutting end-to-end relation axially outwardly of the first tube, each having its groove positioned axially outwardly. The yarn package tube is preferably made of multi-ply paper, as previously mentioned.

The yarn package tube 16 includes a groove 26 cut or formed into the tube surface so that the groove lies in a plane essentially perpendicular to the axis of the tube and mandrel and extends circumferentially partly around the package tube. The groove could also extend completely around the package tube. The side walls of the groove meet at the bottom in an acute angle. It is generally preferable that the groove does not extend completely around the circumference of the tube so as to make it easier to slide the waste bunch off the end of the tube when the transfer tail is to be connected to the leading yarn end of another yarn package.

Circumferential grooves adjacent to or spaced from one end of a yarn package tube are generally well-known in the art. The above-mentioned Pabis U.S. Pat. No. 3,276,704 broadly discloses one in a two tube arrangement, while the Sowell U.S. Pat. No. 3,284,023 and Heatherly U.S. Pat. No. 3,103,305 describe and specifically illustrate in detail some possible configurations of such grooves. The Adams et al U.S. Pat. No. 3,717,291 is still another disclosure of a specifically illustrated circumferential groove.

One of the things uniquely different about the invention from the art, as mentioned previously, is the formation of a corner as by a cross-cut notch or slit 28, which is cut or formed in the surface of the yarn package tube in such manner as to intersect one of the side walls of the groove and form therewith an angle preferably an acute angle, with the resulting corner facing toward the direction of intended rotation of the yarn package tube. The side walls of the cross-cut notch may converge to an acute angle (see FIGS. **5*a*, 5*b* and 5*c***) so as to provide a sharp pinch point for the yarn, as mentioned above. As also previously stated, the cross-cut notch may be formed in such manner that the resulting acute-angled corner is displaced over the groove and toward the opposite side wall of the groove. The corner should not be displaced to such extent as to touch the opposite side wall of the groove because there should be no hindrance to the yarn entering the groove. Also, the corner may be raised slightly above or from the surface of the tube cylindrical body, as previously stated. The corner may further be both displaced over the groove and raised slightly above the surface of the tube cylindrical body. In any of these situations, the purpose is to provide assurance that the yarn will be picked-up or snagged and deflected by the acute-angled corner in the manner disclosed.

Transfer Tail Apparatus

The transfer tail apparatus, as mounted on the housing 12 of the yarn winder, includes a yarn laying guide assembly 30 and a movable pigtail guide assembly 32 that are operatively connected for working together in a coordinated manner to be described. The transfer tail apparatus may also include a single lever controlled cocking mechanism, which is indicated generally at 34 and may be operatively connected to the yarn laying guide assembly and movable pigtail guide assembly so that the operator may move them together automatically from a first position to a second or latched position in preparation for thread-up of the yarn to the transfer tail apparatus and subsequent connection of the yarn to the yarn package tube for winding the yarn thereon. "Threadup" or similar words, for purposes of this description, means threading the yarn through the transfer tail apparatus preparatory to "tie-up" of the yarn to the yarn package tube.

The yarn laying guide assembly 30 is located on one side of the yarn winder housing adjacent the yarn traverse guide 22 and the yarn traverse roll 20. The outer axial end of the mandrel is that end over which yarn package tubes are loaded and unloaded.

The pigtail yarn guide assembly 32 is located on the winder housing 12 on the opposite side thereof from the yarn laying guide assembly, and is positioned so that the pigtail portion 38 is essentially at a level with the center line or axis of the winder mandrel 18 when the drive roll 14 is in driving engagement with the yarn package tube.

It should be understood that the invention disclosed herein is not limited to the use of a pigtail guide per se, because any suitable yarn retaining means may also be used. Therefore, the term "pigtail" is merely a convenient term to describe any suitable structure that will perform a similar yarn retaining function.

Yarn Laying Guide Assembly

The yarn laying guide assembly 30 may comprise a fixed yarn transfer plate 40 of the configuraton illustrated, and a yarn transfer slide plate 42 that is capable of being moved linearly relative to the fixed yarn transfer plate. The slide plate has an inwardly leading slot 44 (FIG. 2) for receiving the yarn 24 during the thread-up operation by the operator. The fixed yarn transfer plate has a cam guiding surface 46. When the yarn laying guide assembly has been moved to the second or latched position by the operator, whether manually by hand or by use of the aforementioned single lever cocking mechanism 34, the yarn transfer slide plate is moved essentially in a straight line or linear direction relative to and to the right of the fixed transfer plate or axially outwardly relative to the yarn tube package. The latching of the yarn laying guide assembly may be provided by the cocking mechanism in the manner to be described. The moving yarn 24, when initially threaded in the transfer tail apparatus, will ride in the slot 44. When the yarn transfer slide plate moves in return to the first position, upon being released in a suitable manner by the operator to initiate the yarn tie-up, the slide plate slides to the left of the fixed transfer plate or axially inwardly relative to the yarn tube package and thereby brings the yarn into engagement with the cam guiding surface 46. Continued movement of the slide plate 42 causes the yarn to be forced from the open slot 44 by the cam guiding surface 46 until the yarn slips free of the slot and rides solely against the cam guiding surface with the yarn finally slipping free of the cam guiding surface for subsequent pick-up by the yarn traverse guide 22.

Pigtail Yarn Guide Assembly

The pigtail yarn guide assembly 32 is mounted on the winder housing in such manner as to swing or pivot below the winder housing in an arc relative to the surface of the yarn package tube on the winder mandrel. The aforementioned pigtail portion 38 extends from the outer end of the swinging guide bar 48. The opposite end of the swinging guide bar is pivotally connected to the winder housing. When the pigtail yarn guide assembly is moved from its first position to its second or latched position, the pigtail portion 38 in its swinging or pivoting action approaches within about one-quarter inch from the surface of an empty yarn package tube 16 mounted on the winder mandrel. The latching of the pigtail yarn guide assembly may be provided by the cocking mechanism in the manner to be described. In the second or latched position, the pigtail portion lies inwardly of alignment with the groove in the yarn package tube. In the return to first position, the pigtail portion is finally positioned clear of the yarn package tube to one's right when facing the winder in the aforedescribed manner.

Single Lever Cocking Mechanism

The single lever cocking mechanism 34 comprises a shaft 50, which is suitably journaled in the winder housing 12 and which may also be connected at its lower end to the swinging guide bar 48 for enabling the pigtail yarn guide assembly to pivot or swing in the manner described. The upper end of the shaft 50 extends through the top of the winder housing and has connected thereto a handle 52 to be grasped by the operator when cocking the transfer tail apparatus. Intermediate along the cocking shaft is a rotary cam member 54 having a pin 56, the rotary cam member being attached to rotate with the shaft. Disposed above the rotary cam member for rotation relative to the shaft is a cocking throw member 58. A rod or lever 60 is pivotally connected at its one end to the crank arm 61, which extends from one side of the cocking throw member 58. The other end of the rod or lever 60 is pivotally connected to one end of a rocker arm 62.

The rocker arm 62 is suitably pivoted at a pivot point 64 across the width of the winder housing 12, and at its other end it is pivotally connected to the remote end 66 of the yarn transfer slide plate 42 of the yarn laying guide assembly 30.

Figure 1:
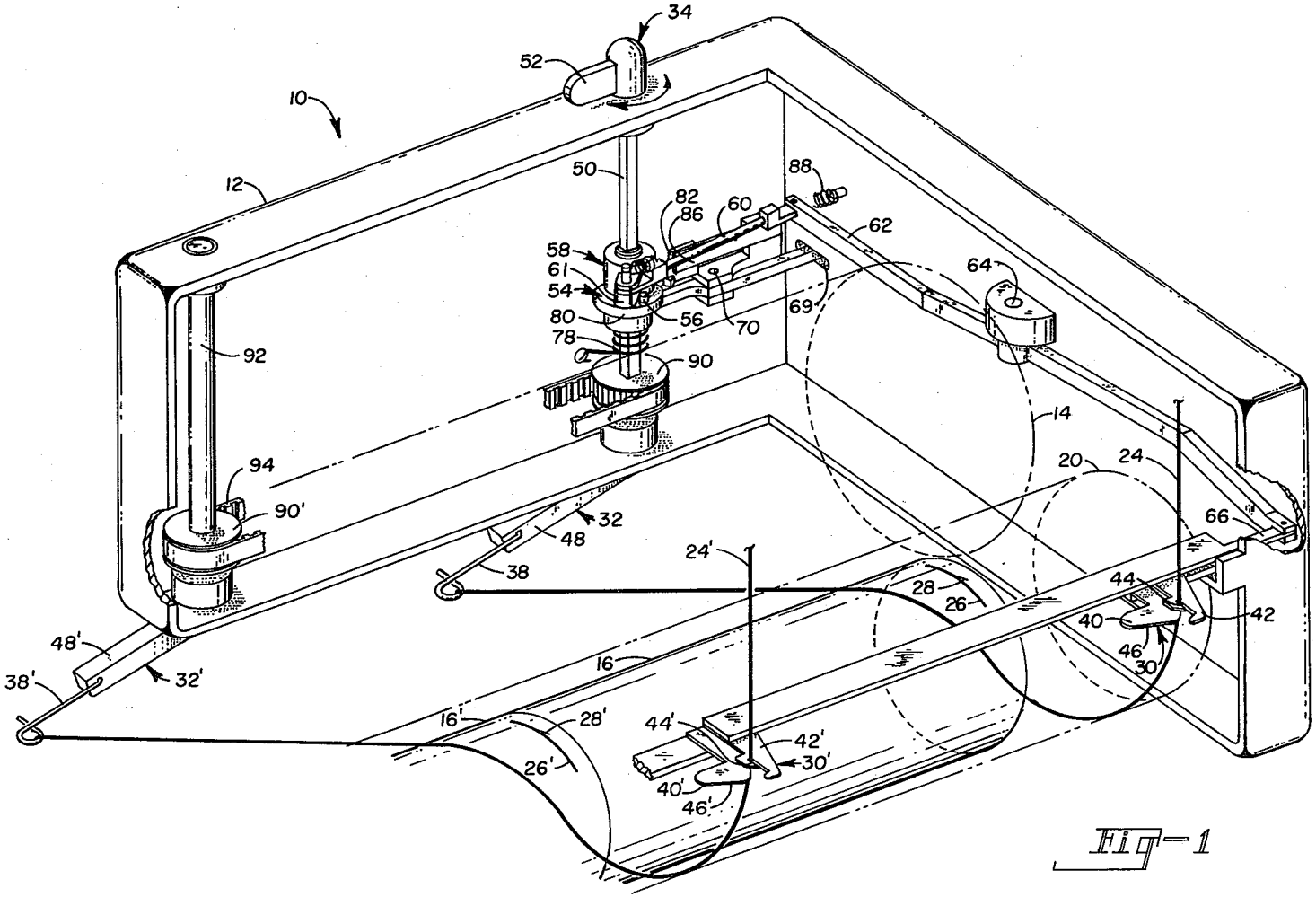
FIG. 1 is an isometric view of the yarn winder, broken away in part to illustrate the various parts of the dual yarn tie-up and transfer tail apparatus, the cocking mechanism for the yarn tie-up and transfer tail apparatus, the path of the yarn upon initial thread-up through the yarn laying guide assembly and pigtail yarn guide assembly with respect to the yarn traverse roll (shown in phantom lines) and drive roll (shown in phantom lines), and the position of the yarn package tubes mounted end-to-end on the same winder mandrel (not shown) relative to the yarn path and yarn traverse and drive rolls.
Figure 2:
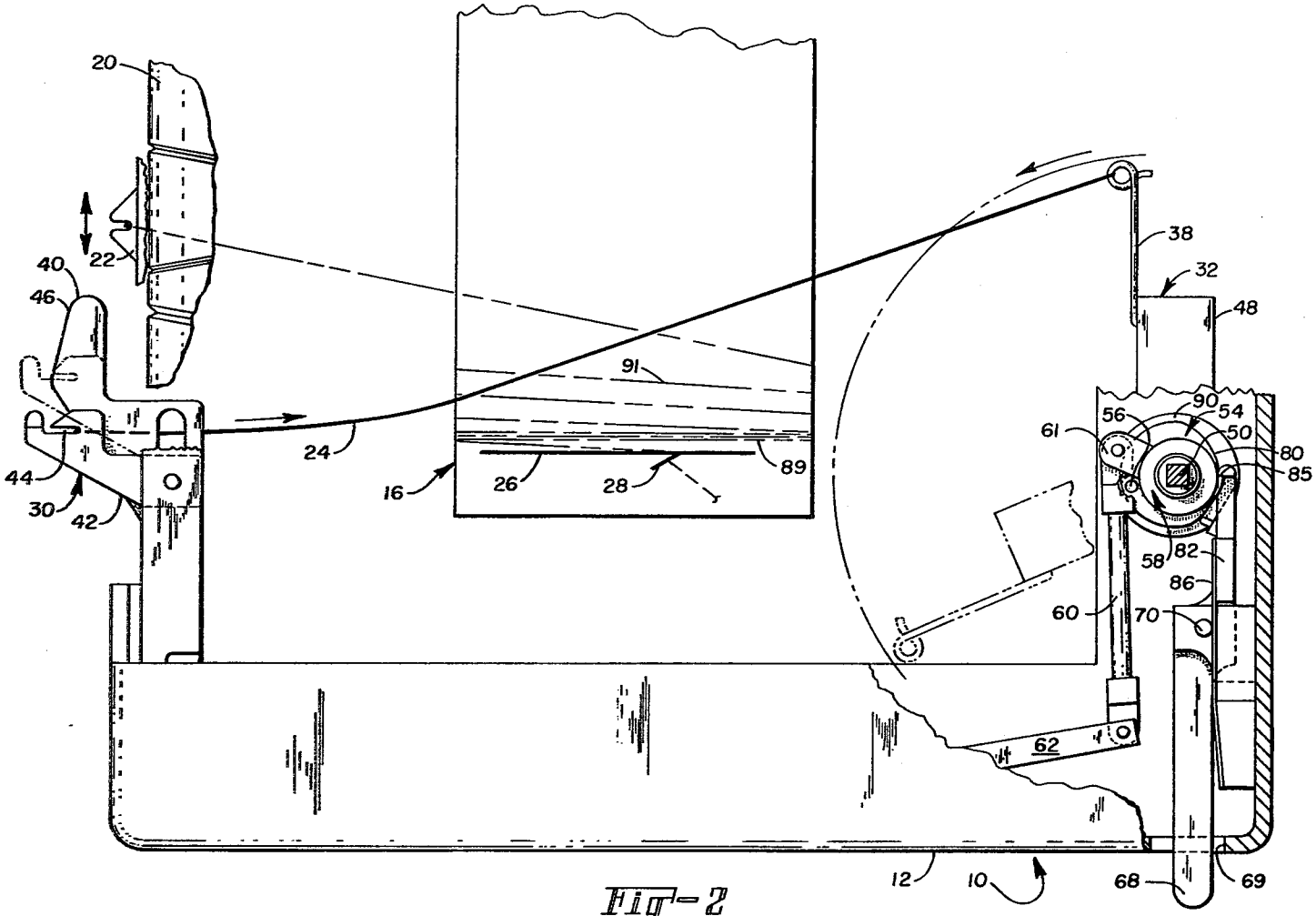
FIG. 2 is a plan view of the yarn winder, broken away in part to illustrate the relative initial positions in solid lines of the yarn, one of the yarn laying guide assemblies and of one of pigtail yarn guide assemblies to the groove and corner in the yarn package tube upon thread-up, and also illustrates part of the cocking mechanism for the yarn tie-up and transfer tail apparatus.
Figure 4:
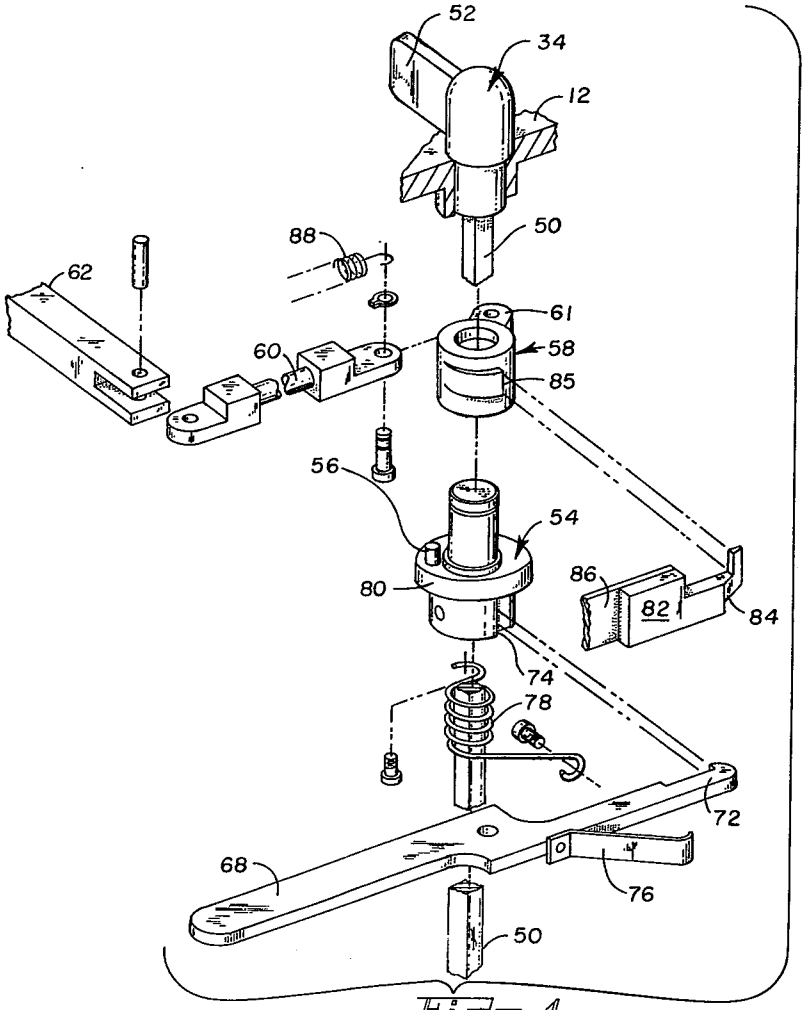
FIG. 4 is an enlarged, exploded view of the cocking mechanism, angularly rotated to a position to show the intercooperation of the pertinent parts of the mechanism.
Figure 3:
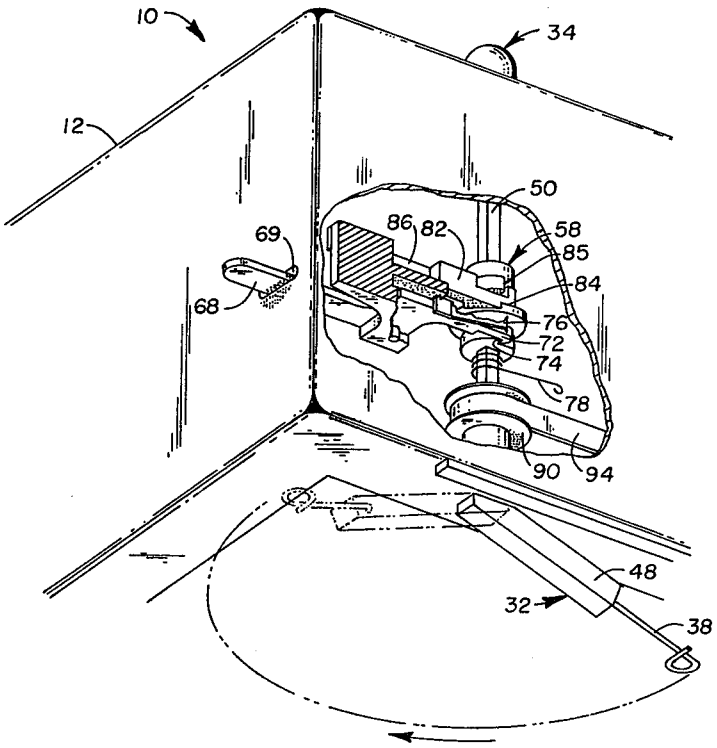
FIG. 3 is an isometric view of the yarn winder from a different angle, broken away in part to illustrate the cocking mechanism for the yarn tie-up and transfer tail apparatus and one of the pigtail yarn guide assemblies and its path of movement.

As the cocking shaft 50 is rotated by the operator, the connected rotary cam member 54 is also rotated thus causing the pin 56 thereon to rotate into engagement with the crank arm 61 and force rotation also of the cocking throw member 58. The rotation of the cocking throw member serves to move the rod or lever 60, which in turn rocks the rocker arm 62 about its pivot point and thereby cause movement of the yarn transfer slide plate 42 to the latched position, such as shown in FIG. 2, for instance.

A latch release lever 68 extends at one end through an opening 69 in an end wall of the winder housing 12, by which release lever the operator may initiate the release for return to the first position the pigtail yarn guide assembly and the yarn laying guide assembly. The latch release lever may be in the form of a rocker arm which is suitably pivoted at a pivot point 70. The opposite end 72 of the latch release lever is notched for latching engagement with a shoulder abutment 74 on the rotary cam member 54 upon cocking rotation of the rotary cam member. The opposite end 72 of the latch release member is urged into latching engagement by a leaf spring 76.

When the operator releases the latch release lever 68 by rocking it about its pivot point 70 against the biasing effect of the leaf spring 76, the notched end 72 of the latch release lever is released from latching engagement with the shoulder abutment 74 on the rotary cam member 54. The rotary cam member is caused to revolve in return to its uncocked position by a helical torsion spring 78, which is positioned around the cocking shaft 50 with one end of the spring being fixed to the winder housing and the other end fixed to the rotary cam member 54. When the rotary cam member reaches a predetermined position in its rotating return, its elliptical shaped cam surface 80 engages against a spring-biased throw latch 82, which in turn has a notched end 84 for latching engagement with a shoulder abutment 85 on the cocking throw member 58. The throw latch 82 is urged into latching engagement by a second leaf spring 86. Upon release of the throw latch 82 from the shoulder abutment 74, the cocking throw member 58 is in turn enabled to rotate in return to its uncocked position by an extension spring 88, which has one end fixed to the winder housing and the other end fixed to the cocking throw member. The release and rotation of the cocking throw member 58 causes the rocker arm 62 through the pivotally connected rod or lever 60, to rock about its pivot point 64 and the rocker arm 62 in turn causes the aforedescribed sliding movement relative to the fixed transfer plate 40 of the yarn transfer slide plate 42 in return to its first position.

Operation

In threading-up the yarn 24 to the transfer tail apparatus on the yarn winder 10, the operator, by means of the single lever cocking mechanism 34, causes both the yarn laying guide assembly 30 and the pigtail yarn guide assembly 32 to be moved from their respective first positions to their respective second or latched positions.

Then, by means of an air doffer (not shown) into which the yarn is moving from a source of supply (not shown), the operator manually guides the continuously moving yarn (1) to pass into the opening leading into the slot 44 of the yarn transfer slide plate 42 of the yarn laying guide assembly 30; (2) to extend past and above the yarn package tube 16; and (3) finally to pass through and be retained for movement therethrough by the pigtail portion 38 of the pigtail yarn guide assembly 32.

Next, the operator lowers the winder housing 12 and thereby moves the drive roll 14, which is rotating, into driving engagement with the yarn package tube so as to bring the yarn package tube up to appropriate winding speed. The downward movement of the winder housing also causes movement downwardly of the connected yarn laying guide assembly 30, the pigtail yarn guide assembly 32, the yarn traverse roll 20 and drive roll 14, as well as the continuously moving yarn that has been threaded through the two yarn guide assemblies, into operating position. The yarn is thereby forced to ride in a partial arch, i.e., in engagement with a surface portion of the cylindrical yarn package tube 16. As will be noted from FIG. 2, the yarn extends between the two yarn guides in a path that takes the yarn axially inwardly of and free from contact with the groove 26. The operator is now ready to initiate the operation of the transfer tail apparatus, once the winder mandrel and its associated yarn package tube are rotating together at appropriate winding speed.

The operator manually releases the latch release lever 68 by rocking it about its midpoint pivot 70. This rocking action causes the notched end 72 of the lever to be moved from abutting engagement with the shoulder abutment 74 on the rotary cam member 54, the latter then being released for spring-biased rotary return movement and thereby causing movement in return to the first position of the pigtail yarn guide assembly 32.

The pigtail yarn guide assembly 32 moves in a sidewise direction thus guiding the yarn sideways along the surface of the yarn package tube 16 until the yarn drops into the groove 26 in the surface of the yarn package tube, as shown in FIG. 5*a*, and a portion of the yarn exiting from the groove is running across one of the groove side wall shoulders.

When the corner, as formed by cross-cut notch, rotates into position, the yarn portion exiting from the groove is picked-up or snagged and deflected by the acute-angled corner (note FIG. 5*b*). As the acute-angled corner rotates with the yarn package tube away from where the yarn enters the groove, the direction of yarn movement of the portion of the yarn deflected by the acute-angled corner is changed (note FIG. 5*c*). It is only a momentary change of direction because the tension suddenly exerted between the point where the yarn is being deflected and where the yarn is going into the air doffer (not shown) increases to such extent as to cause a snapping and severance of the yarn going through the pigtail yarn guide assembly and to the air doffer. The yarn is thus connected to the yarn package tube by either the pinch point in the cross-cut notch or the pinch point in the groove or a combination of both pinch points. In using a multi-ply paper tube, the yarn may also be pinched in the multi-ply layers at the acute-angled corner. The yarn will usually break near the pigtail guide portion 38, and this will occur slightly past the point of closest approach that the pigtail portion comes to the surface of the yarn package tube 16.

The pigtail yarn guide assembly 32 continues its return movement until it reaches a predetermined point along its path of movement where the yarn laying guide assembly 30 becomes triggered for release for its return movement. The exact position of this triggering action is determined by the point along the cam surface 80 on the rotary cam member 54 where the throw latch 84 is forced from abutting engagement with shoulder abutment 74 on the cocking throw member 58.

The movement of the pigtail yarn guide assembly between the time when the yarn becomes snapped and severed and the time when initiation or triggering of release for movement of the yarn laying guide assembly is predetermined so as to provide sufficient time to wind a waste bunch 89, as shown in phantom lines in FIG. 2, on the yarn package tube adjacent the inboard side of the groove, since the position of the yarn laying guide assembly in its latched position lies just axially inwardly of alignment with the groove.

Upon release of the yarn laying guide assembly 30 for its return movement, the yarn is moved laterally axially inwardly along the tube from the groove, and the speed of such lateral movement is correlated with the speed of rotation of the tube so as to form spaced helical or spiral wraps 91, as shown in phantom lines in FIG. 2, between the yarn waste bunch and the location where the package portion is to be wound.

As previously stated, it is not essential that the cross-cut notch 28 be provided with converging side walls due to the subsequent change of yarn direction when the yarn becomes severely bent around the acute-angled corner of the notch, coupled also with the yarn being at the same time held in part in the groove at the point where the groove side walls intersect in an acute angle. There is sufficient retention of or holding of the yarn to prevent slippage so as to cause the subsequent increased tension on and snapping and severing of the yarn. The yarn may, after severing, be held by the groove. Also, if the yarn package tube is made from multi-ply paper, the yarn may become snagged also in the plies of the paper, as heretofore mentioned. It is preferable, however, to employ converging side walls for the cross-cut notch to further minimize slippage once the yarn has become severed.

The description given thus far applies not only to a single yarn package tube transfer tube transfer tail formation but also to more than one yarn package tube transfer tail operation for more than one yarn package tube mounted end-to-end on the same winder mandrel. A second pair of yarn laying guide assembly 30' and pigtail yarn guide assembly 32', for instance and as illustrated in the drawings, may be interconnected for simultaneous operation with their corresponding first yarn guiding structures. For instance, the movable yarn transfer slide plate 42 of the yarn laying guide assembly may be interconnected or, as shown, be made as one common member to be moved when the rocker arm 62 is moved. The second pigtail yarn guide assembly 32' may be rotatably interconnected to the first pigtail yarn guide assembly 32 by means of a gear pulley 90 mounted for rotation on and with cocking shaft 50, a second gear pulley 90' mounted for rotation on and with shaft 92, to which the second pigtail yarn guide assembly is connected, with the first gear pulley 90 transmitting its rotation to the second gear pulley by a toothed belt or timing gear belt 94. The shaft 92 is journalled for rotation in the winder housing 12.

All other duplicate elements, which correspond to parts heretofore mentioned, have been given reference numbers having prime marks, even though not specifically referred to herein.

The invention has been described in detail with particular reference to preferred embodiments thereof, but it will be understood that variations and modifications can be effected within the spirit and scope of the invention.

We claim:

1. Apparatus for tying-up a yarn to and for forming a yarn transfer tail on a yarn package tube that is supported on a rotating mandrel of a yarn winder, the yarn moving continuously from a source of supply to the yarn package tube for engagement with a portion of the surface thereof and away from the tube, as into an air doffer, the portion of said surface to be engaged rotating in the same direction as the direction of yarn movement, the yarn winder having a self-threading yarn traverse guide reciprocating along a path parallelly spaced from the package portion of the yarn package tube, the supported yarn package tube comprising:

(a) a substantially cylindrical body having formed in its external surface adjacent one end thereof a groove defined by a pair of side walls extending into the surface of the cylindrical body and extending at least partly around said cylindrical body in a plane substantially perpendicular to the rotation axis of the tube, and (b) the cylindrical body also having adjacent the one side wall of the groove closest to said one end of the cylindrical body means defining a corner intersecting said one side wall of the groove and pointing generally in the direction of intended rotation of the tube, which is adapted in rotary winding operations, as a yarn enters the groove in one direction of movement, to snag and deflect a portion of the yarn exiting from the groove around said corner for changing the direction of movement of the exiting yarn portion as said corner rotates with the tube away from where the yarn approaches said surface portion of the tube;

the apparatus comprising:

means for positioning the yarn in engagement with said surface portion of the yarn tube in a partial arch at an initial location along the tube length that is away from and out of contact with the groove and the corner;

said positioning means including a first and second yarn guide means through each of which the yarn is threaded, the first yarn guide means being mounted at a position along the length of one side of the yarn package tube, the position being slighly axially inwardly of alignment with the groove on the yarn package tube and the second yarn guide means being mounted at a position along the length of the other side of the yarn package tube axially inwardly of alignment with said groove;

means for releasing and moving said second yarn guide means along a path of movement relative to said other side of the yarn tube for guiding the yarn sideways along said surface portion of the tube from said initial location toward said groove and corner until the yarn drops into the grooves and the portion of the yarn exiting from the groove becomes snagged and deflected around the corner as the corner rotates with the tube away from where the yarn approaches said surface portion of the tube, and consequently tying-up the yarn to the tube and subsequently snapping and severing the yarn from the yarn moving away from the tube and through the second yarn guide means;

said first yarn guide means, upon said snapping and severing of the yarn, adapted to guide the continuously moving yarn onto the tube into a predetermined number of wraps as the tube rotates to form a waste bunch at a location that is axially inwardly along the tube length from the groove; and means for releasing and moving said first yarn guide means along a path of movement relative to said one side of the yarn tube axially inwardly from the groove and corner, after formation of the yarn waste bunch, for guiding the continuously moving yarn onto the tube into a predetermined number of spaced helical wraps as the tube rotates, to form a transfer tail at a location that is axially inwardly along the tube length from the waste bunch;

said first yarn guide means adapted as it moves along its path of movement to release the guided yarn for subsequent pick-up by the yarn traverse guide for guiding the yarn as the yarn is thereafter wound on the package portion of the yarn package tube at a location that is axially inwardly from the transfer tail.

2. Apparatus as defined in claim 1, wherein the second yarn guide means is mounted for movement along its said path of movement in a plane that passes approximately through the axis of the tube about one-quarter of the way around the tube from where the yarn first engages the surface of the tube.

3. Apparatus as defined in claim 1, wherein each of said first and second yarn guide means is adapted to be moved in its said path of movement from a first position to a latched second position, and upon being released by its said releasing means, to be moved in return to its first position.

4. Apparatus as defined in claim 1, wherein each of said first and second yarn guide means has a latching means.

5. Apparatus as defined in claim 1, wherein said means for releasing said first yarn guide means is actuated in response to the second yarn guide means reaching a predetermined point along its path of movement.

6. Apparatus as defined in claim 1, wherein the first yarn guide means is adapted to be moved in essentially a straight line path parallel to the length of the yarn package tube, and the second yarn guide means is adapted to be moved in an arcuate path along the length of the yarn package tube.

7. Apparatus as defined in claim 1, wherein the mandrel of the yarn winder has a length long enough for supporting at least two yarn package tubes end-to-end, and the apparatus mounted on the yarn winder comprises a separate first and second yarn guide means for the yarn moving to an individual yarn package tube supported on the mandrel, each separate first and second yarn guide means having means connected to the other corresponding yarn guide means for operating said corresponding guide means at the same time to tie-up yarn to and to form transfer tails on each of the individual yarn package tubes.

8. Apparatus as defined in claim 1, wherein the position of said first yarn guide means, when the yarn is positioned at said initial location on said surface portion of the tube, is no more than about one-quarter of an inch from alignment with said groove.

9. Apparatus as defined in claim 1, wherein said corner includes a side wall intersecting said one side wall of the groove in an acute angle of about 25° to about 60°.

10. Apparatus as defined in claim 1, wherein said corner includes a side wall intersecting said one side wall of the groove in an acute angle of about 30° to about 45°.

11. Apparatus as defined in claim 1, wherein said corner includes a side wall intersecting said one side wall of the groove in an acute angle of about 35°.

12. Apparatus as defined in claim 1, wherein said corner is displaced from said one side wall of the groove in a direction toward the opposite side wall of the groove and extends in part over the groove.

13. Apparatus as defined in claim 1, wherein said pair of side walls of the groove meet in an acute angle at the bottom of the groove.

14. Apparatus as defined in claim 1 wherein the corner is raised slightly above the surface of said cylindrical body.

15. Apparatus as defined in claim 12, wherein the corner is also raised slightly above the surface of said cylindrical body.

16. Apparatus as defined in claim 1 wherein said corner is bounded on one side by a cross-cut notch that is defined by a pair of side walls converging to an acute angle away from said one side wall of said groove.

* * * * *